United States Patent [19]

Kuroda et al.

[11] 4,262,485

[45] Apr. 21, 1981

[54] LOW BOILING POINT MEDIUM POWER PLANT

[75] Inventors: Michio Kuroda, Hitachi; Shozo Nakamura, Hitachi-Ota; Ryoichiro Oshima; Takamitsu Taki, both of Hitachi, all of Japan

[73] Assignee: Hitachi, Ltd., Tokyo, Japan

[21] Appl. No.: 964,818

[22] Filed: Nov. 30, 1978

[30] Foreign Application Priority Data

Dec. 2, 1977 [JP] Japan ..... 52/143910

[51] Int. Cl.[3] ..... F01K 11/02; F01K 25/10

[52] U.S. Cl. ..... 60/669; 60/641; 60/649; 60/671; 165/106; 165/140; 290/1 A

[58] Field of Search ..... 60/641, 669, 651, 671, 60/649; 165/106, 140; 290/1 A

[56] References Cited

U.S. PATENT DOCUMENTS

| | | | |
|---|---|---|---|
| 1,804,694 | 5/1931 | Jones | 60/669 X |
| 3,349,247 | 10/1967 | Birkestrand | 60/669 X |
| 3,988,895 | 11/1976 | Sheinbaum | 60/641 |
| 4,043,386 | 8/1977 | Franz | 60/641 X |
| 4,069,673 | 1/1978 | Lapeyre | 60/669 X |
| 4,144,715 | 3/1979 | Fleck | 60/641 |

*Primary Examiner*—Allen M. Ostrager
*Attorney, Agent, or Firm*—Craig & Antonelli

[57] ABSTRACT

A low boiling point medium power plant in which heated waste gas, such as furnace gas, geothermic steam, etc., is used as a heat source for heating an intermediate thermal medium by means of an indirect heat exchanger, and the intermediate thermal medium is used as a heat source for heating a turbine driving low boiling point medium by means of a direct heat exchanger. The indirect heat exchanger and the direct heat exchanger are rendered into a unitary structure and contained in a sealed housing together with a turbine, a generator and a condenser, whereby a compact overall size can be obtained in a low boiling point medium power plant.

9 Claims, 3 Drawing Figures

LOW BOILING POINT MEDIUM POWER PLANT

BACKGROUND OF THE INVENTION

1. Field of the Invention

This invention relates to low boiling point medium power plants, and more particularly to a compact power plant of the type described wherein heat exchangers, a turbine, a generator and other equipment are rendered unitary in structure.

2. Description of the Prior Art

In building a low boiling point medium power plant of the prior art, it has hitherto been customary to construct and install a heat exchanger, a turbine, a generator and other equipment as separate and independent entities. Such plant generally includes a heat exchanging section for introducing waste heat into the plant. Due to the fact that the temperature of waste heat is generally low, the heat exchanging section tends to become very large in size, thereby making it impossible to obtain a compact overall size in a low boiling point medium power plant. Such plant uses a low boiling point medium, such as freon, which is very expensive. Since the low boiling point medium tends to leak to the outside, it is necessary to exercise extraordinary cautions in constructing a sealing mechanism for the medium and to routinely observe extraordinary precautions in the operation of the plant. In view of the technical and economic problems thus involved in this type of power plant, full realization of advantages from use of this type of power plant has been hampered by inability to provide satisfactory solutions to these problems.

SUMMARY OF THE INVENTION

This invention has as its object the provision of a compact low boiling point medium power plant wherein heat exchangers, a turbine, a generator and other equipment are rendered unitary in structure and a sealing mechanism of simple construction is used for sealing a low boiling point medium.

This invention provides a power plant of the type described which has the following characteristic features. An intermediate thermal medium having a higher critical temperature than a low boiling medium used is interposed between the waste heat and the low boiling point medium, so as to increase the range of temperatures of waste heat that can be utilized. Means is provided for preventing the direct leakage of the low boiling point medium into the heated waste gas to thereby raise the standards of safety of the plant. Meanwhile the intermediate thermal medium is used for lubrication of bearings for the turbine and generator.

A direct heat exchanger is used for effecting heat exchange between the intermediate thermal medium and the low boiling point medium, so as to greatly reduce the volume of the heat exchanger.

The low boiling point medium is not completely separated from the intermediate thermal medium during operation of the plant as by using the low boiling point medium for driving the turbine and cooling the generator, so that a small portion of one medium is incorporated in the other medium during operation of the plant. By this feature, a sealing mechanism for the turbine, generator, reducing gearing and condenser can be simplified in construction, thereby enabling all the equipment of the plant to be rendered unitary in structure.

By virtue of these features, the invention enables a compact power plant to be obtained by designing the plant in such a manner that a heater for heating the intermediate thermal medium by the waste heat, the direct heat exchanger for effecting heat exchange between the intermediate thermal medium and the low boiling point medium, the turbine, the generator and a condenser are housed in a single housing.

DESCRIPTION OF THE PREFERRED EMBODIMENT

The invention will now be described by referring to an embodiment thereof shown in the accompanying drawings.

Figure 1:
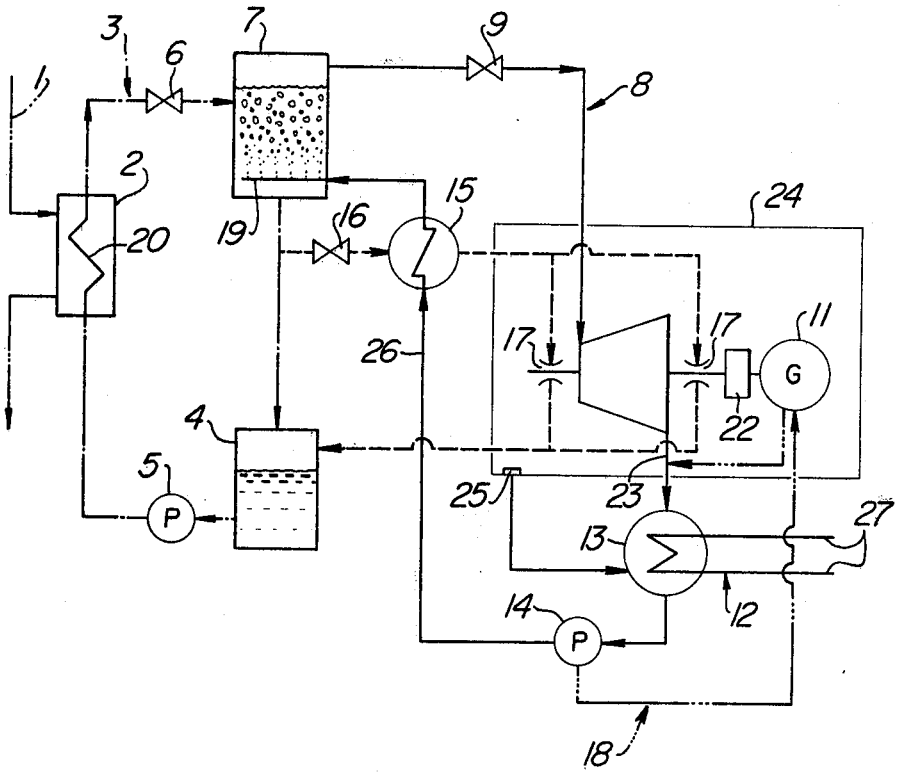
FIG. 1 is a systematic diagram of the low boiling point medium power plant according to the present invention.

FIG. 1 is a systematic diagram showing the arrangement of the power plant according to the invention. The heat of a heated waste gas 1 is introduced into the plant through an intermediate thermal medium heater 2 and transferred through an intermediate thermal medium system generally designated by the reference numeral 3 to a low boiling point medium. More specifically, an intermediate thermal medium is supplied by an intermediate thermal medium pump 5 from an intermediate thermal medium collecting means 4 to the intermediate thermal medium heater 2 where the intermediate thermal heater is heated by the heated waste gas 1 through heat transfer tubing 20. The intermediate thermal medium thus heated is passed through a direct heat exchanger inlet valve 6 into a direct heat exchanger 7, where the intermediate thermal medium is subjected to heat exchange with a low boiling point medium. Thereafter the intermediate thermal medium is returned to the intermediate thermal medium collecting means 4.

The direct heat exchanger 7 is a heat exchanger in which the intermediate thermal medium is brought into direct contact with the low boiling point medium so that heat exchange may take place between them.

In this embodiment, the heater 7 is a natural circulation system and used also as the intermediate thermal medium collecting means 4 shown in FIG. 1. Consequently, the pump 5 and the valve 6 shown in FIG. 1 are not used in this embodiment.

A system shown in solid lines is a low boiling point medium system generally designated by the reference numeral 8. The low boiling point medium in a gaseous state released from the direct heat exchanger 7 passes through a turbine inlet valve 9 into a low boiling point medium turbine 10 to operate the same, so that rotation of the turbine 10 will drive a generator 11 through a speed reducing gearing 22. The gas from the turbine 10 is vented through an exhaust line 23 and introduced into a low boiling point medium condenser 13 which is cooled by a cooling water system generally designated by the reference numeral 12 having a cooling water inlet and a cooling water outlet 27. The low boiling point medium in the form of a gas is condensed in the condenser 13, and the condensate is pressurized by a low boiling point medium pump 14 and flows through a liquid feeding line 26, which passes through an intermediate thermal medium cooler 15, into nozzles 19 from which the liquid is ejected in atomized particles into the direct heat exchanger 7.

A portion of the intermediate thermal medium released from the direct heat exchanger 7 passes through a bearing valve 16 and gives off heat in the intermediate thermal medium cooler 15 to heat the low boiling point medium. The portion of the intermediate thermal medium which has had its temperature reduced in this way to a level satisfactory for effecting lubrication of bearings is supplied to bearings 17 of the turbine 10 and the generator 11. After lubricating the bearings 17, the intermediate thermal medium returns to the intermediate thermal medium collecting means 4.

The generator 11 is cooled by a generator cooling system generally designated by the reference numeral 18 connected at one end thereof to the liquid feeding line 26 to draw off the condensate which cools the generator 11 by the latent heat of vaporization and then returns to the low boiling point medium condenser 13.

In the systematic diagram shown in FIG. 1, it will be seen that the intermediate thermal medium and the low boiling point medium, which have hitherto been completely separated from each other in plants of the prior art, are mixed with each other in the direct heat exchanger 7, and that the low boiling point medium turbine 10 and the generator 11 operate in a low boiling point medium atmosphere while the bearings 17 are lubricated by the intermediate thermal medium. Thus the turbine 10 and condenser 11 can be housed in a generating area generally designated by the reference numeral 24 occupying a limited space.

The medium which leaks into the generating area 24 in small amounts is led through steam suction ports 25 into the condenser 13 where it is condensed. Operating in an atmosphere of the intermediate thermal medium and the low boiling point medium, all the equipment of the power plant can be rendered unitary in structure and housed in a housing without requiring a complex mechanism for sealing the connections between various elements of the plant, particularly the low boiling point medium turbine 10, generator 11 and low boiling point medium condenser 13.

The intermediate thermal medium may be selected from the group consisting of turbine oil, hindered ester oil and alkylbenzene oil. The low boiling point medium may be selected from the group consisting of freon, toluene and refrigerant 85.

Figure 2:
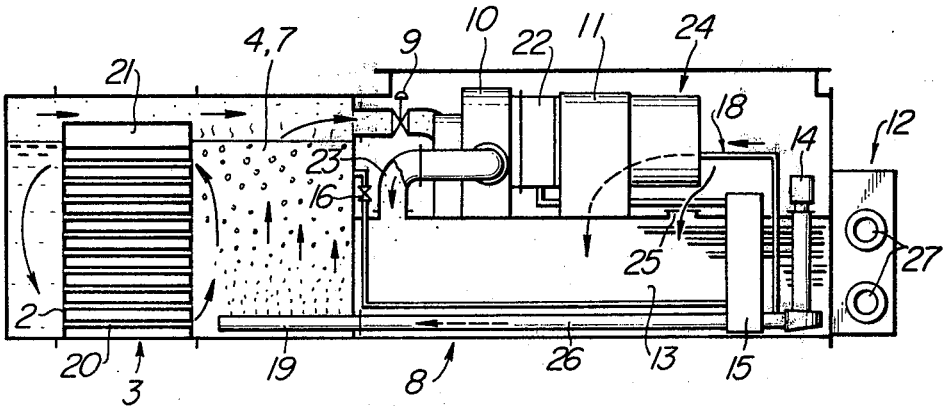
FIG. 2 is a schematic front view of an embodiment of the low boiling point medium power plant according to the invention.
Figure 3:
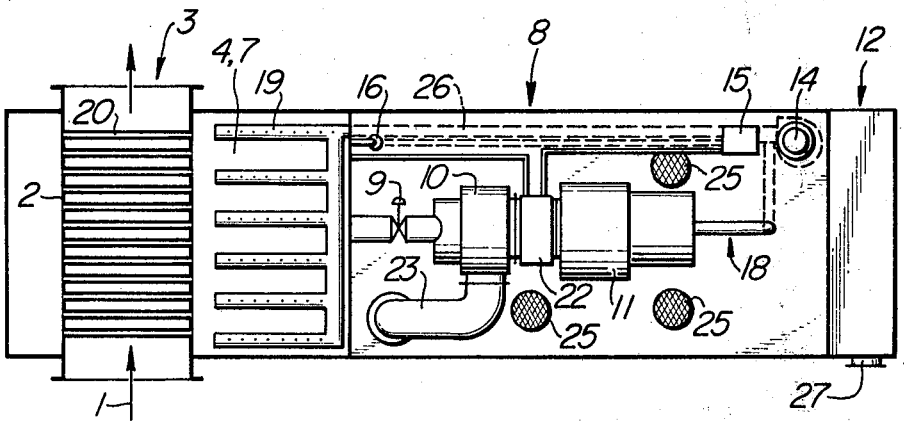
FIG. 3 is a plane view of the power plant shown in FIG. 2.

FIGS. 2 and 3 show one embodiment of the invention in which the intermediate thermal medium flowing in the direction of an arrow is heated by the heat of the heated waste gas 1 in the intermediate thermal medium heater 2. The intermediate thermal medium is subjected to heat exchange with the low boiling point medium in the direct heat exchanger 7 to change the latter into a gaseous state. The condensate of the gaseous low boiling point medium is ejected through the nozzles 19 into the direct heat exchanger 7 and is evaporated therein. When evaporated, the low boiling point medium produces bubbles which cause an ascending stream of the medium to be formed in the heater 7 to thereby promote circulation of the intermediate thermal medium. A balancing flow path 21 is provided above the liquid level of the intermediate thermal medium heater 2 for collecting the vapor of the intermediate thermal medium generated in the heat transfer tubing 20.

The gaseous low boiling point medium produced in the direct heat exchanger 7 is led through the turbine inlet valve 9 to the low boiling point medium turbine 10 to rotate the turbine 10. Since this type of turbine 10 is a high speed rotation turbine, rotation of the turbine is transmitted through the speed reducing gearing 22 to the generator 11 to generate power. After doing work in the turbine 10, the gaseous low boiling point medium is led through the exhaust line 23 to the low boiling point medium condenser 13 where the gaseous medium is condensed.

The condensate of the low boiling point medium drawn off the delivery side of the low boiling point medium pump 14 is led through the generator cooling system 18 to the generator 11 where the condensate is vaporized to cool the generator 11 by the latent heat of vaporization. After cooling the generator 11, the vaporized medium is exhausted into the low boiling point medium condenser 13.

Lubrication of the low boiling point medium turbine 10, speed reducing gearing 22 and generator 11 is effected by a portion of the intermediate thermal medium drawn off the direct heat exchanger 7 and led through the bearing valve 16 to the intermediate thermal medium cooler 15 where the medium is cooled by the condensation of the low boiling point medium and then distributed to the various elements. After effecting lubrication, the intermediate thermal medium is returned to the direct heat exchanger 7. The low boiling point medium turbine 10, speed reducing gearing 22 and generator 11 are housed unitarily in a casing which is completely sealed or kept in a condition in which leakage is minimized. The pressure in the generating area 24 in which the generator 11 and other equipment are located is substantially equal to atmospheric pressure if other equipment is completely sealed, or substantially equal to the pressure of the steam in the low boiling point medium condenser 13 if vapor leaks from other equipment to a certain extent. In case there is some leakage, the steam suction ports 25 are formed to admit the leaked vapor to the low boiling point medium condenser 13 to be condensed therein by the cooling water flowing through the cooling water inlet and outlet 27.

The condensate is fed by the low boiling point medium pump 14 through the liquid feeding line 26 to the direct heat exchanger 7.

FIG. 3 shows the plant as viewed in the direction of an arrow III in FIG. 2. The relative positions of various elements of the plant described by referring to FIG. 1 are clearly indicated in FIG. 3.

The use of the direct heat exchanger 7 enables the volume of the heat exchanger to be reduced to about one half the volume of an indirect heat exchanger of the prior art. Moreover, the use of the direct heat exchanger 7 enables the circulation of the intermediate thermal medium to be promoted by vapor bubbles produced in the direct heat exchanger. A reduction in the size of the heat exchanger is an important factor concerned in the reduction of the overall size of the power plant according to this invention.

According to the invention, lubrication of the bearings 17 and the gears is effected by using the intermediate thermal medium, and the generator 11 and gears operate in a low boiling point medium atmosphere. This permits various elements of the power plant to be contained in a sealed casing, thereby providing a solution to the problem of leakage which is encountered with regard to a low boiling point medium turbine.

In the power plant according to the invention, a loss suffered in the generator is compensated for by condensing the vapor of the low boiling point medium, and a loss suffered in the bearings and gears is compensated for by recovering the intermediate thermal medium after its temperature is elevated. Thus the power plant has the advantage that it is low in loss.

The power plant according to the invention has its elements arranged in the order in which fluids flow smoothly to enable the overall size of the plant to be reduced. More specifically, the intermediate thermal medium heater 2, direct heat exchanger 7 and generating equipment are arranged in the indicated order so that waste heat can be utilized rationally for generating power.

The power plant according to the invention is contained in its entirety in a housing, so that the plant is sealed tight and compact in size to be readily transported. Thus the power plant according to the invention offers all the advantages which could be offered by compact power plants utilizing waste heat.

The present invention provides a power plant utilizing waste heat which provides solutions to the problems of large size and leakage of vapor encountered in low boiling point medium power plants of the prior art, and which is superior to power plants of the prior art in being much smaller in overall size and far easier to transport.

What is claimed is:

1. A low boiling point medium power plant utilizing waste heat comprising:

intermediate thermal medium heater means for transferring heat from a waste heat source to an intermediate thermal medium;

direct heat exchanger means for transferring heat from said intermediate thermal medium to a low boiling point medium; and generator means coupled to said turbine means for generating power; wherein said intermediate thermal medium heat means and said direct heat exchanger means are both disposed in a single casing in a heat exchanging relationship with each other, with the intermediate thermal medium flowing between the heater means and the heat exchanger means so that the heater means and heat exchanger means form a single unit.

2. A low boiling point medium power plant as claimed in claim 1, wherein a flow of said low boiling point medium is produced by a buoyance of vapor bubbles thereof in said direct heat exchanger means, said flow of said low boiling point medium is utilized for causing said intermediate thermal medium to circulate therein, whereby the intermediate thermal medium can be made to flow in a stream.

3. A low boiling point medium power plant as claimed in claim 1, wherein said power plant further comprises condenser means, and wherein said turbine means, said generator means and said condenser means are disposed in said single casing.

4. A low boiling point medium power plant as claimed in claim 1, wherein said power plant further comprises condenser means, arranged beneath said generator means.

5. A low boiling point medium power plant as claimed in claim 4, wherein said turbine means, said generator means, and said condenser means are disposed in said single casing.

6. A low boiling point medium power plant comprising;

intermediate thermal medium heater means for transferring heat from a waste source to an intermediate thermal medium;

direct heat exchanger means for transferring heat from said intermediate thermal medium to a low boiling point medium;

turbine means driven by said low boiling point medium; and generator means coupled to said turbine means for generating power; and means for drawing off a condensate of said low boiling point medium from a delivery side of a low boiling point medium pump and for introducing the same to said generator so as to cool said generator means by latent heat of vaporization of the condensate; and wherein said intermediate thermal medium heater means for recovering heat from the waste heat source and said direct heat exchanger means for heating said low boiling point medium are in a heat exchanging relationship and form a single unit.

7. A low boiling point medium power plant as claimed in claim 2, wherein said power plant further comprises means for introducing a vapor obtained by vaporization of said low boiling point medium into the condenser means to compensate for a loss suffered in said generator means.

8. A low boiling point medium power plant comprising:

intermediate thermal medium heater means for transferring heat from a waste heat source to an intermediate thermal medium;

direct heat exchanger means for transferring heat from said intermediate thermal medium to a low boiling point medium;

turbine means driven by said low boiling point medium; and generator means coupled to said turbine means for generating power; and means for utilizing said intermediate thermal medium for effecting lubrication of said turbine means, said generator means and gearing means coupling said turbine means to said generator means; and wherein said intermediate thermal medium heater means for recovering heat from the waste heat source and said direct heat exchanger means for heating said low boiling point medium are in a heat exchanging relationship and form a single unit.

9. A low boiling point medium power plant as claimed in claim 8, wherein said intermediate thermal medium is recovered after its temperature is elevated, so as to compensate for a loss suffered in effecting lubrication.

* * * * *